US011607889B2

(12) United States Patent
Gao et al.

(10) Patent No.: US 11,607,889 B2
(45) Date of Patent: Mar. 21, 2023

(54) REMANUFACTURED INK CARTRIDGE AND ELECTRONIC PATCH

(71) Applicant: GEEHY MICROELECTRONICS INC., Zhuhai (CN)

(72) Inventors: Tao Gao, Zhuhai (CN); Fengjun Song, Zhuhai (CN); Weichen Liu, Zhuhai (CN)

(73) Assignee: GEEHY MICROELECTRONICS INC., Zhuhai (CN)

( * ) Notice: Subject to any disclaimer, the term of this patent is extended or adjusted under 35 U.S.C. 154(b) by 10 days.

(21) Appl. No.: 17/190,759

(22) Filed: Mar. 3, 2021

(65) Prior Publication Data

US 2021/0187960 A1 Jun. 24, 2021

Related U.S. Application Data

(63) Continuation of application No. PCT/CN2019/097331, filed on Jul. 23, 2019.

(30) Foreign Application Priority Data

Oct. 23, 2018 (CN) ..... 201811232947.X
Dec. 24, 2018 (CN) ..... 201811580469.1

(51) Int. Cl.
*B41J 2/175* (2006.01)

(52) U.S. Cl.
CPC ..... *B41J 2/17546* (2013.01); *B41J 2/17526* (2013.01)

(58) Field of Classification Search
CPC B41J 2/17546; B41J 2/17526; B41J 2/17559; B41J 2/1753; B41J 2/17503
(Continued)

(56) References Cited

U.S. PATENT DOCUMENTS 8,602,542 B2 12/2013 Joda et al.
2014/0225946 A1* 8/2014 Quinn ..... B41J 2/17559 347/7
2015/0059148 A1 3/2015 Toshiaki et al.

FOREIGN PATENT DOCUMENTS

CN 1785676 A 6/2006
CN 104442010 A 3/2015
(Continued)

OTHER PUBLICATIONS

European Patent Office, Extended Search Report for EP19876867.3, dated Sep. 15, 2021, 8 Pages.
(Continued)

*Primary Examiner* — Matthew Luu
*Assistant Examiner* — Alexander D Shenderov
(74) *Attorney, Agent, or Firm* — Anova Law Group PLLC

(57) ABSTRACT

A remanufactured ink cartridge and an electronic patch are provided in the present disclosure. A remanufactured ink cartridge includes an ink accommodation container; an original chip disposed at an outer side of the ink accommodation container, where the original chip includes a first memory; and an electronic patch disposed between the original chip and the ink accommodation container. The electronic patch includes a second memory and first programming terminals electronically connected to the second memory; the first programming terminals are configured to program data for repairing to the second memory; the data for repairing is configured to repair or replace at least a portion of data in the first memory; and at least one of the first programming terminals is exposed outside the original chip.

20 Claims, 4 Drawing Sheets

(58) Field of Classification Search
USPC ..... 347/87
See application file for complete search history.

(56) References Cited

FOREIGN PATENT DOCUMENTS

| | | | |
|---|---|---|---|
| CN | 204506141 | U | 7/2015 |
| CN | 205467927 | U | 8/2016 |
| CN | 107839347 | A | 3/2018 |
| CN | 207889360 | U | 9/2018 |
| CN | 109572222 | A | 4/2019 |
| EP | 3369577 | A1 | 9/2018 |
| WO | 2016018290 | A1 | 2/2016 |

OTHER PUBLICATIONS

The World Intellectual Property Organization (WIPO), International Search Report for PCT/CN2019/097331, dated Oct. 10, 2019, 6 Pages (including translation).
The China National Intelleectual Property Administration (CNIPA), The China Search Report for 2018115804691, dated Aug. 16, 2019, 7 page.

* cited by examiner

REMANUFACTURED INK CARTRIDGE AND ELECTRONIC PATCH

CROSS-REFERENCE TO RELATED APPLICATIONS

This application is a continuation application of PCT Patent Application No. PCT/CN2019/097331, filed on Jul. 23, 2019, which claims the priority of Chinese patent application No. 201811232947.X, filed on Oct. 23, 2018, and No. 201811580469.1, filed on Dec. 24, 2018, the entirety of all of which is incorporated herein by reference.

TECHNICAL FIELD

The present disclosure generally relates to the field of image forming consumables and, more particularly, relates to a remanufactured ink cartridge and an electronic patch.

BACKGROUND

Ink-based image-forming devices may use ink to print images on media. Typically, the ink contained in a fluid ink cartridge (e.g., an ink cartridge) may be exhausted with continuous use, and the ink cartridge must be replaced to continue the operation of the image-forming device at this point. Such ink cartridge that the ink has been exhausted may usually still have a complete cartridge structure and a cartridge chip with a complete circuit structure, especially the integrated ink cartridge including a printhead. Such ink cartridge that the ink has been exhausted may become a new electronic waste once being discarded, causing environmental pollution and resources waste.

SUMMARY

One aspect of the present disclosure provides a remanufactured ink cartridge. The remanufactured ink cartridge includes an ink accommodation container; an original chip, disposed at an outer side of the ink accommodation container, where the original chip includes a first memory; and an electronic patch, disposed between the original chip and the ink accommodation container. The electronic patch includes a second memory and first programming terminals electronically connected to the second memory; the first programming terminals are configured to program data for repairing to the second memory; the data for repairing is configured to repair or replace at least a portion of data in the first memory; and at least one of the first programming terminals is exposed outside the original chip.

Optionally, the original chip includes a first substrate, and the electronic patch includes a second substrate; a partial region of the second substrate is exposed outside the first substrate; and the at least one of the first programming terminals is disposed at the exposed partial region of the second substrate.

Optionally, a length of the second substrate is greater than a length of the first substrate, and/or a width of the second substrate is greater than a width of the first substrate, thereby forming the exposed partial region; or the first substrate and the second substrate are staggered with each other, thereby forming the exposed partial region.

Optionally, the original chip includes a first positioning hole, and the electronic patch includes a second positioning hole, where a center of the second positioning hole substantially coincides with a center of the first positioning hole.

Optionally, an area of the second positioning hole is less than or equal to an area of the first positioning hole.

Optionally, the original chip further includes functional terminals, configured to be electrically connected to a probe of a printer; and the electronic patch further includes electrical connection terminals, electrically connected to an end portion of at least one of the functional terminals exposed at a side of the original chip facing toward the ink accommodation container.

Optionally, the electronic patch further includes second programming terminals, electronically connected to the second memory through the electrical connection terminals; and at least one of the second programming terminals is exposed outside the original chip.

Optionally, the electrical connection terminals are soldered to the end portion of the at least one of the functional terminals.

Optionally, an area of an electrical connection terminal is less than an area of a functional terminal connected there-to.

Optionally, a quantity of the electrical connection terminals included in the electronic patch is less than a quantity of the functional terminals included in the original chip.

Optionally, the functional terminals, electrically connected to the electrical connection terminals, include data terminals and clock terminals.

Another aspect of the present disclosure provides a remanufactured ink cartridge. The remanufactured ink cartridge includes an accommodation container; a printhead; an original chip, including a first substrate, where a plurality of functional terminals is arranged on the first substrate; and a remanufactured chip, including a second substrate, where a plurality of soldering terminals and a plurality of programming terminals are arranged on the second substrate; and the plurality of soldering terminals is electrically connected to a part of the plurality of functional terminals. A length and/or a width of the second substrate are greater than a length and/or a width of the first substrate; and at least one of the plurality of programming terminals is configured to be arranged at a position of the second substrate that has the greater length and/or the greater width; or the first substrate and the second substrate are staggered with each other, thereby forming an exposed partial region; and the at least one of the plurality of programming terminals is configured to be arranged at the exposed partial region.

Optionally, a first positioning hole is disposed at the first substrate, and a second positioning hole is disposed at the second substrate.

Optionally, a center of the second positioning hole substantially coincides with a center of the first positioning hole; and/or an area of the second positioning hole is less than an area of the first positioning hole.

Optionally, removing a film from a backside of the part of the plurality of functional terminals of the original chip; and the plurality of soldering terminals of the remanufactured chip is soldered on the backs of the part of the plurality of functional terminals after removing the film.

Optionally, the plurality of programming terminals includes first programming terminals and second programming terminals; and the second programming terminals are electrically connected to the plurality of soldering terminals.

Optionally, a quantity of the plurality of soldering terminals is less than a quantity of the plurality of functional terminals.

Another aspect of the present disclosure provides an electronic patch, configured to be installed between an ink accommodation container of a remanufactured ink cartridge and an original chip. The electronic patch includes a second memory; electrical connection terminals, configured to establish an electrical communication with a probe of a printer through at least one terminal of the original chip; and first programming terminals, connected to the second memory, where the first programming terminals are configured to program data for repairing or data for upgrading of at least a portion of data in the original chip to the second memory. When the electronic patch is installed between the ink accommodation container and the original chip, at least one of the first programming terminals is exposed outside the original chip.

Optionally, the electronic patch further includes second programming terminals, connected to the second memory through the electrical connection terminals. When the electronic patch is installed between the ink accommodation container and the original chip, at least one of the second programming terminals is exposed outside the original chip.

Optionally, a quantity of the electrical connection terminals included in the electronic patch is less than a quantity of terminals in the original chip.

Other aspects of the present disclosure can be understood by those skilled in the art in light of the description, the claims, and the drawings of the present disclosure.

BRIEF DESCRIPTION OF THE DRAWINGS

In order to clearly illustrate the technical solutions in the embodiments of the present disclosure, the drawings, which are required to be used in the description of the disclosed embodiments, are briefly described hereinafter. It should be understood that the following drawings may merely be some embodiments of the present disclosure and are not to be considered as the scope limitation. Other drawings derived from such drawings may be obtained by those skilled in the art without creative work.

DETAILED DESCRIPTION

Figure 1:
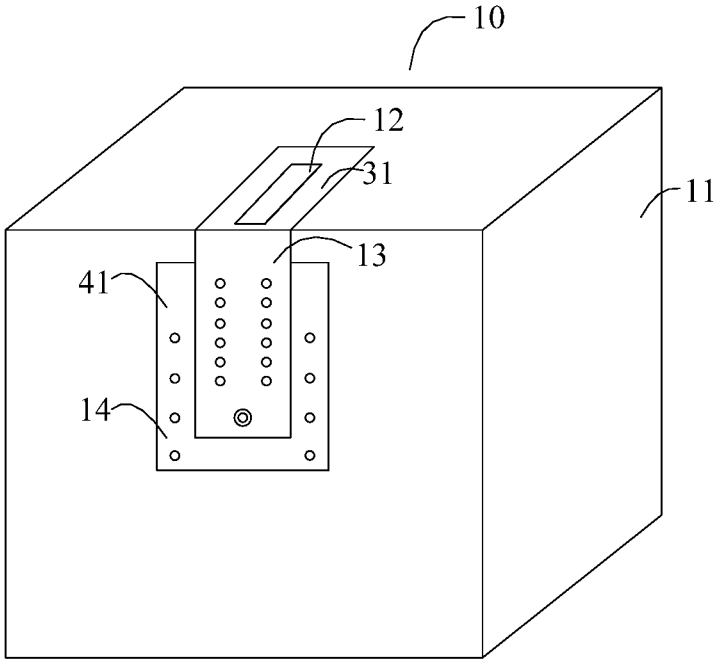
FIG. 1 illustrates a structural schematic of a remanufactured ink cartridge according to various embodiments of the present disclosure.

Hereinafter, the embodiments of the present disclosure are described in more detail with reference to the accompanying drawings. Although certain embodiments of the present disclosure are shown in the accompanying drawings, it should be understood that the present disclosure may be implemented in various forms and should not be construed as being limited to the embodiments set forth herein. On the contrary, such provided embodiments are used to more thoroughly and completely understand the present disclosure. It should be understood that the accompanying drawings and embodiments of the present disclosure may merely be used for exemplary purposes and may not be used to limit the protection scope of the present disclosure.

It should be noted that similar reference numerals and subtitles indicate similar items in the accompanying drawings mentioned below. Therefore, once an item is defined in one accompanying drawing, it does not need to be further defined and explained in subsequent accompanying drawings.

In the description of the present disclosure, it should be noted that the orientation or positional relationship indicated by the terms "upper", "lower", "inner", "outer" and the like are based on the orientation or positional relationship indicated by the accompanying drawings, or the orientation or positional relationship that the invented product is usually placed in use, which is merely for the convenience of describing the present disclosure and simplifying the description and does not indicate or imply that the device or element must have a specific orientation and must be configured and operated in a specific orientation. Therefore, such orientation or positional relationship may not be understood as a limitation of the present disclosure. Furthermore, the terms "first", "second", and the like may merely be used for distinction description and may not be understood as indicating or implying relative importance.

In the existing technology, the ink cartridge may include an ink accommodation container and an original chip attached to the outer side of the ink accommodation container. Two main existing installation manners for repairing an electronic patch (also known as "remanufactured chip") of a remanufactured ink cartridge are the following.

For the first installation manner, the electronic patch may cover a side of the original chip away from the ink accommodation container, and For the second installation manner, the electronic patch may be disposed between the original chip and the ink accommodation container. In such manner, all terminals of the electronic patch may be covered by the original chip and may include programming terminals which are configured to program data for repairing to the electronic patch.

For the first manner, the terminals corresponding to all terminals on the original chip may need to be arranged on the electronic patch which results in complicated operations, and electrical short circuits may be likely to occur between a plurality of terminals, such that the second manner may be mostly used. However, when using the second manner, the data of the electronic patch may be programed only before the installation, that is, the data may be programmed to the electronic patch first, and the electronic patch may then be installed on the remanufactured ink cartridge, so that the installation sequence may not be changed. The process limitation of programming first and installing later may complicate the remanufacturing process of the ink cartridge. For example, the model of the electronic patch may need to be matched with the model of the ink cartridge before installation. Furthermore, the electronic patch needs to be peeled off when repairing or upgrading of a covered electronic patch.

Inventors of the present disclosure have discovered defects/problems of the above-discussed solution after their practices and careful studies. Therefore, the discovery process of the above-mentioned defects/problems and the technical solutions thereof as described in the present disclosure are encompassed within the scope of the present disclosure.

In view of the above-mentioned problems, the present disclosure provides a remanufactured ink cartridge, an electronic patch, and a method for forming the remanufactured ink cartridge, which are described hereinafter.

Referring to FIG. 1, FIG. 1 illustrates a structural schematic of a remanufactured ink cartridge 10 according to various embodiments of the present disclosure. As shown in FIG. 1, the remanufactured ink cartridge 10 may include an ink accommodation container 11 (also called an "accommodation container"), a printhead 12, an original chip 13, and an electronic patch 14.

The ink accommodation container 11 may be configured to contain ink for forming images. The printhead 12 may be configured to eject the ink in the ink accommodation container 11 onto an image-forming medium, such as paper. The printhead 12 may include a plurality of heating resistors, each having a corresponding nozzle. By selectively heating the plurality of heating resistors, the ink at the nozzles corresponding to the heating resistors which are heated may be thermally expanded and flow out from the nozzles to form images.

The original chip 13 may be configured to store information data required for the access to printer. The electronic patch 14 may be configured to store the data for repairing which is the data used for repairing the damaged data in the original chip 13. The printhead 12 may be disposed on the sidewall of the ink accommodation container 11. The original chip 13 and the electronic patch 14 may in a communication connection. For example, when a printer accesses the required data, the printer may transmit access instructions to the original chip 13 and the electronic patch 14 simultaneously.

Figure 2:
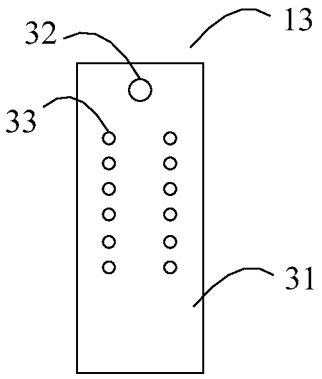
FIG. 2 illustrates a structural schematic of an original chip according to various embodiments of the present disclosure.
Figure 3:
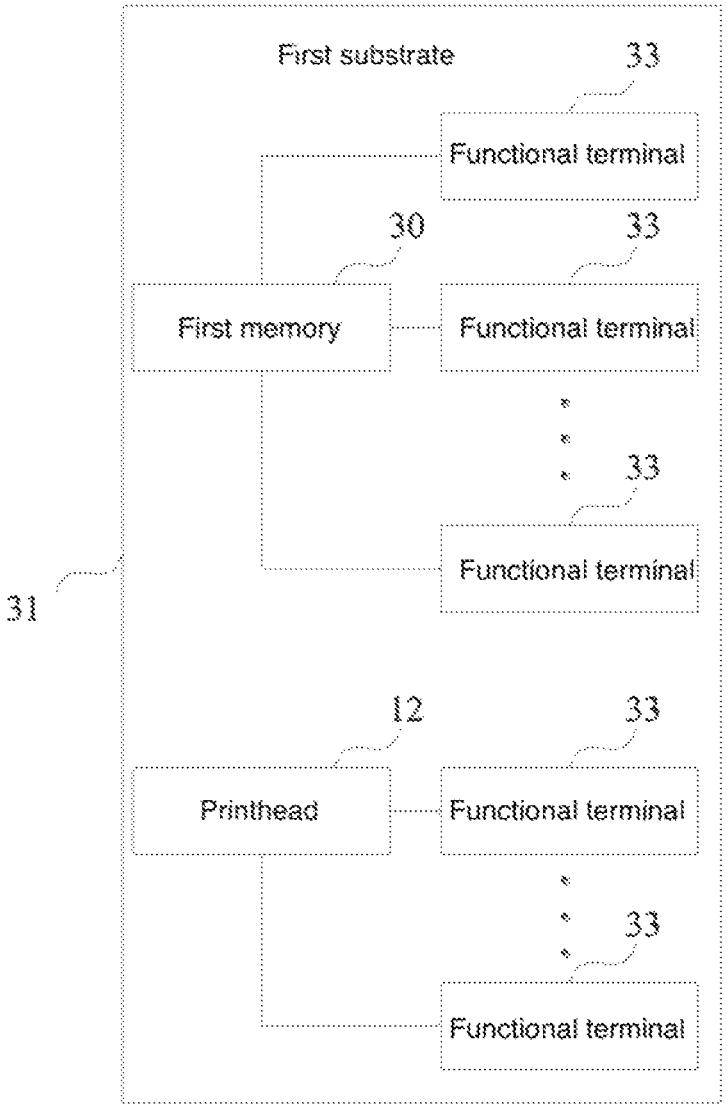
FIG. 3 illustrates a schematic of an electrical connection relationship of the original chip in FIG. 2.

Referring to FIGS. 2-3, FIG. 2 illustrates a structural schematic of the original chip 13 according to various embodiments of the present disclosure; and FIG. 3 illustrates a schematic of an electrical connection relationship of the original chip 13 in FIG. 2.

The original chip 13 may include a first memory 30. Moreover, the original chip 13 may further include a first substrate 31, and a first positioning hole 32 and a plurality of functional terminals 33 which are exemplarily arranged on the first substrate 31. The first substrate 31 may be configured to be attached to the sidewall of the ink accommodation container 11. The first substrate 31 may include a flexible substrate or a rigid substrate. The first positioning hole 32, exemplarily configured to be a ring shape, may be arranged at an end portion of the first substrate 31. The plurality of functional terminals 33 may be configured to be connected to the first memory 30 through wires, such that the printer may establish a communication path with the first memory 30 through the plurality of functional terminals 33.

In some implementation manners, the printhead 12 may be disposed on the first substrate 31, and at this point, the plurality of functional terminals 33 may also be configured to establish the data communication between the printhead 12 and the printer. In other implementation manners, the printhead 12 and the first memory 30 may both be arranged on the first substrate 31, and at this point, the ink jet control circuit of the printhead 12 and the circuit of the first memory 30 may be integrated in a same circuit network. The plurality of functional terminals 33 may exemplarily include data terminals and clock terminals. The data terminals may be configured to transmit data signals. The data signals may be, for example, an ink jet control data signal transmitted from the printer to the printhead 12, a data read/write instruction signal transmitted from the printer to the first memory 30, a data signal stored in the first memory 30 and fed back to the printer by the first memory 30, and the like. The clock terminals may be configured to transmit clock signals which may be transmitted from the printer to the printhead 12 to control the ink jet sequence and transmitted to the first memory 30 to control the read/write sequence. Furthermore, the functional terminals 33 may also include a ground terminal, and/or other signal terminals, and the like. Furthermore, the quantity of the first positioning hole 32 may be more than one, and the shape of the first positioning hole 32 may not be limited to a ring shape.

Moreover, according to different signal transmission targets, the above-mentioned plurality of functional terminals 33 may include: a first terminal group, where each terminal in the first terminal group is only connected to the first memory 30, and the printer may access the data of the original chip 13 through the first terminal group; a second terminal group, where each terminal in the second terminal group is only connected to the above-mentioned printhead 12, and the second terminal group is configured to receive an ink jet control signal transmitted from the printer to the printhead 12; and a third terminal group, where the third terminal group includes terminals connected to the first memory 30 and the printhead 12 and is configured to simultaneously transmit the control signal to the first memory 30 and the printhead 12.

Exemplarily, the first terminal group may include ID terminals. When the printer performs data verification on the remanufactured ink cartridge 10, the printer may transmit read/write instructions to the first memory 30 through the ID terminals, and the verification data fed back by the first memory 30 may also be transmitted to the printer through the ID terminals. The second terminal group may include heating signal terminals. The heating signal terminals may be electrically connected to the heating resistors of the printhead 12; and the printer may selectively transmit heating signals to the heating signal terminals, connected to the heating resistors, to control ink jet. Exemplarily, the second terminal group may further include control terminals, configured to transmit ink jet control signals C SYNC, and the like; and the ink jet control signals may be configured to control the ink jet operation.

The third terminal group may include clock terminals; and the printer may use the clock terminals to simultaneously transmit clock pulses to the printhead 12 and the first memory 30, thereby controlling the working sequence of the printhead 12 and the first memory 30. Exemplarily, the third terminal group may also include data terminals because in some implementation manners, the data signal transmitted from the printer to the printhead 12 may be converted into an address access signal simultaneously, and the address access signal may be transmitted to the first memory 30 for data access. In above-mentioned implementation manners, the data terminals may be connected to the printhead 12 and the first memory 30 simultaneously.

Figure 4:
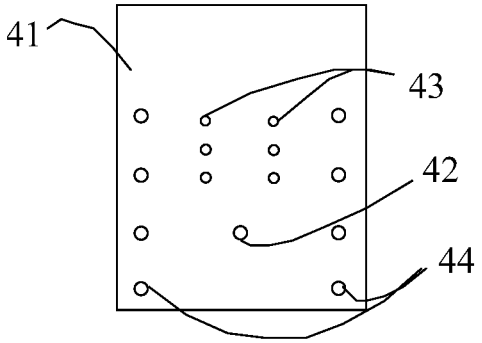
FIG. 4 illustrates a structural schematic of an electronic patch according to various embodiments of the present disclosure.
Figure 5:
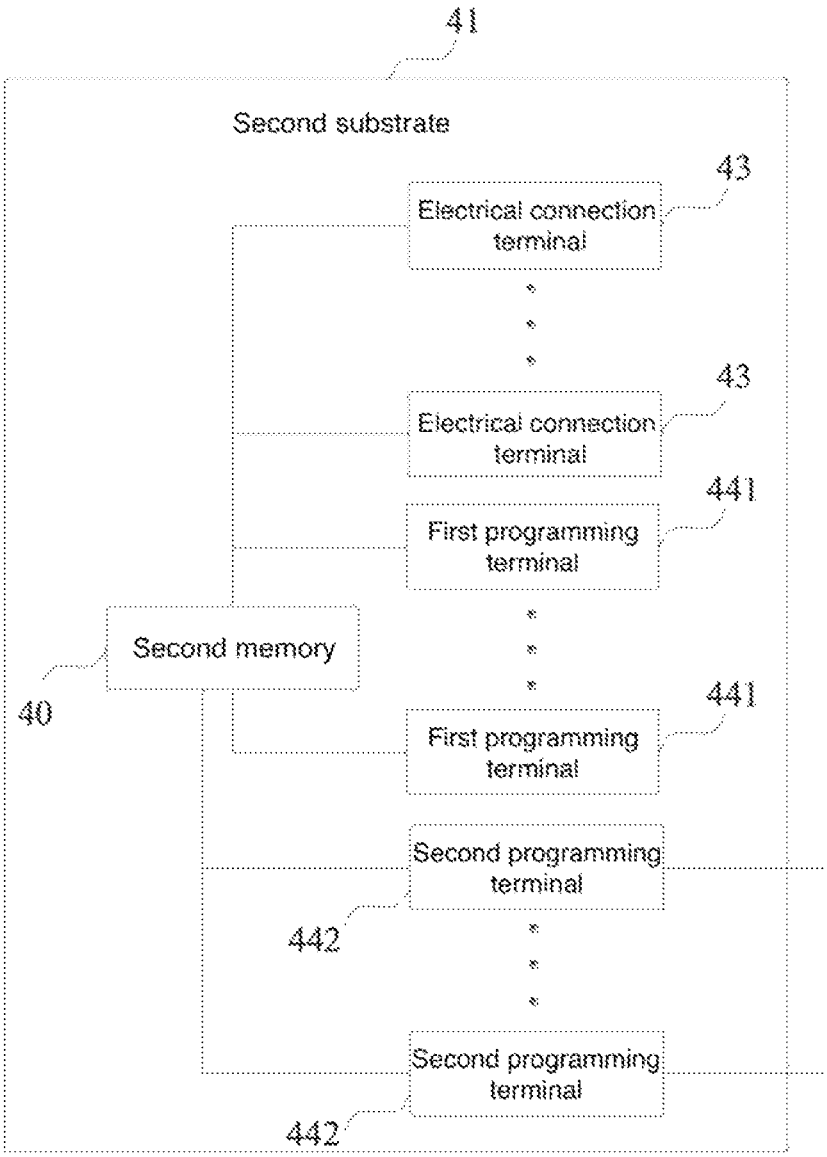
FIG. 5 illustrates a schematic of an electrical connection relationship of the electronic patch in FIG. 4.

Referring to FIGS. 4-5, FIG. 4 illustrates a structural schematic of the electronic patch 14 according to various embodiments of the present disclosure; and FIG. 5 illustrates a schematic of an electrical connection relationship of the electronic patch 14 in FIG. 4.

The electronic patch 14 may include a second memory 40. Moreover, the electronic patch 14 may further include a second substrate 41 and a plurality of programming terminals 44 exemplarily disposed on the second substrate 41. The second substrate 41 may be configured to be attached to the sidewall of the ink accommodation container 11. In particular, the second substrate 41 may be exemplarily arranged between the ink accommodation container 11 and the first substrate 31 of the original chip 13 and may be more adjacent to the side of the ink accommodation container 11. That is, the second substrate 41 may be attached to the side of the first substrate 31 of the original chip 13 facing toward the ink accommodation container 11. Optionally, the second substrate 41 may include a flexible substrate or a rigid substrate, which may not be limited according to various embodiments of the present disclosure.

The plurality of programming terminals 44 may include first programming terminals 441. The first programming terminals 441 may be electrically connected to the second memory 40 and configured to program data to the second memory 40. Exemplarily, the programmed data may be the data for repairing for the damaged data in the original chip 13 or packaged data for the remanufactured ink cartridges 10 of different models. Operations, such as repair, upgrade and the like of the remanufactured ink cartridge 10, may be implemented by installing the electronic patch 14 on the remanufactured ink cartridge 10.

In one embodiment, at least one of the first programming terminals 441 may be exposed outside the original chip 13. In such way, when the electronic patch 14 is installed between the original chip 13 and the ink accommodation container 11, data may be programmed to the second memory 40 through at least one exposed first programming terminal 441.

In the existing technology, the manner that the electronic patch is soldered between the original chip and the ink accommodation container to repair the damaged data in the original chip to implement the remanufacturing and recycling of the ink cartridge may result in a complicated remanufacturing process of the ink cartridge. Moreover, the operation may be extremely inconvenient when the data in the electronic patch needs to be updated. Using the above-mentioned design of the present disclosure, the electronic patch may be disposed first in the remanufactured ink cartridge, and the data of the original chip may then be repaired (i.e., programming the data for repairing to the electronic patch); or the data of the original chip may be repaired first, and the electronic patch may then be disposed in the remanufactured ink cartridge. In other words, the present disclosure may not limit the installation process of the electronic patch 14. Furthermore, when the remanufactured ink cartridge installed with the electronic patch needs to be repaired or re-upgraded, data may be repeatedly programmed to the electronic patch 14 without peeling off the electronic patch 14, which may make operations extremely convenient.

For example, when the electronic patch 14 is disposed, a partial region of the second substrate 41 may be configured to be exposed outside the first substrate 31, and at least one of the first programming terminals 441 may be disposed in the exposed partial region of the second substrate 41, such that the at least one of the first programming terminals 441 may be exposed outside the original chip 13.

For example, in some implementation manners, the first substrate 31 and the second substrate 41 may be staggered with each other. In such way, the first substrate 31 and the second substrate 41 may inevitably have a partial non-overlapped region, and the region on the second substrate 41 which does not overlap with the first substrate 31 may be used to dispose the at least one of the first programming terminals 441.

In other implementation manners, the length of the second substrate 41 of the electronic patch 14 may be greater than the length of the first substrate 31, and/or the width of the second substrate 41 may be greater than the width of the first substrate 31. In such way, a partial region, which is exposed outside the first substrate 31, may be on the second substrate 41 of the electronic patch 14 installed on the remanufactured ink cartridge 10. Correspondingly, the at least one of the first programming terminals 441 may be arranged on such partial region. Moreover, in some other implementation manners, the second substrate 41 of the electronic patch 14 may be configured as a ring shape, such that the second substrate 41 may be arranged, as a ring shape, at the region of the first substrate 31 disposing with the functional terminals 33. Optionally, the ring shape may be, but may not be limited to, a rectangular ring shape, a circular ring shape, and the like.

It should be noted that the above-mentioned manners for forming the exposed partial region of the second substrate 41 may be exemplarily; in one embodiment, other manners may be used to expose a partial region of the second substrate 41 outside the first substrate 31.

Optionally, the plurality of programming terminals 44 may further include second programming terminals 442 disposed on the second substrate 41. The second programming terminals 442 may be electrically connected to the second memory 40 through the electrical connection terminals of the electronic patch 14 described below. The second programming terminals 442 may also be configured to program data for repairing or data for upgrading to the second memory 40. In other words, the first programming terminals 441 connected to the second memory 40 through the electrical connection terminals may be the second programming terminals 442 described in one embodiment. In one embodiment, at least one of the second programming terminals 442 may be exposed outside the original chip 13. For example, at least one of the second programming terminals 442 may be disposed on the above-mentioned partial region of the second substrate 41 exposed outside the first substrate 31. For example, in one case, when the ink data of the original chip 13 is written as an exhausted state, there is a need to store a repair value in the electronic patch 14 that can restore exhausted ink data to a normal ink amount. In another case, there is a need to change the model or upgrade the data of the remanufactured ink cartridge 10. At this point, it is necessary to not only store the repair value data in the electronic patch 14, but also replace the related data matching different models; possibly, it is necessary to store different packaged data (e.g., to replace previously stored package data) in the electronic patch 14 to implement data upgrade. At this point, the related data may include model data, ink amount data, model display data, and may even include verification data and the like at some situations. The packaged data of different models may be different.

Optionally, in one embodiment, only at least one of the first programming terminals 441 and/or at least one of the second programming terminals 442 of the electronic patch 14 may be exposed, such that the data for repairing or upgrading stored in the second memory 40 may not be easily interfered.

Optionally, in order to enable the data for repairing or upgrading stored in the second memory 40 to be accessed by the printer, the second substrate 41 may also be exemplarily arranged with a plurality of electrical connection terminals 43; and the plurality of electrical connection terminals 43 may establish electrical communication with the probe of the printer. Exemplarily, the electrical connection terminals 43 may be electrically connected to a part of the functional terminals 33 of the original chip 13, such that the electrical connection terminals 43 may communicate electrically with the printer through the part of the functional terminals 33 of the original chip 13. For example, when the electronic patch 14 is installed between the original chip 13 and the ink accommodation container 11, the electrical connection terminals 43 may be electrically connected to the backs of the part of the functional terminals 33, where the backs refer to the end portions of the part of the functional terminals 33 exposed on the first substrate 31. When the remanufactured ink cartridge 10 is installed on the printer, the probe of the printer may be in contact with the plurality of functional terminals 33 of the original chip 13, thereby establishing the electrical communication with the electrical connection terminals 43.

When the electronic patch 14 establishes the electrical communication with the printer through the electrical connection terminals 43, the data access signal transmitted by the printer to the first memory 30 may be simultaneously transmitted to the second memory 40, and the feedback data of the access signal may be provided to the printer by the first memory 30 and the second memory 40 simultaneously.

The quantity of the electrical connection terminals 43 may be less than the quantity of the functional terminals 33; and the electrical connection terminals 43 may be electrically connected to a part, not all, of the functional terminals 33 because in most cases, the objective of attaching the electronic patch 14 is to repair or replace the data in the first memory 30 of the original chip 13, and the other part of the functional terminals 33, which only have signal connection with the printhead 12 and transmit the ink jet control signals, may not need to establish the communication with the electronic patch 14. Optionally, the second programming terminals 442 may be connected to the first memory 30 through the electrical connection terminals 43.

Optionally, in some implementation manners of one embodiment, the electrical connection terminals 43 and the backs of the part of the functional terminals 33 may be electrically connected by soldering. Optionally, before soldering, the original chip 13 may be processed through the following steps: peeling off the original chip 13 of the remanufactured ink cartridge from the sidewall of the ink accommodation container 11; removing a film from the backside of the part of the functional terminals 33 that need to be connected by soldering, such that the conductive regions of the part of the functional terminals 33 are exposed; and filling the exposed regions of the functional terminal 33, after removing the film from the backside, with soldering paste. Then, the plurality of electrical connection terminals 43 of the electronic patch 14 may be correspondingly soldered to the part of the functional terminals 33 with exposed backs of the original chip 13, such that the electronic patch 14 and the original chip 13 are connected by soldering. Next, electronic patch 14 and the original chip 13, which are connected by soldering, may be attached to the sidewall of the ink accommodation container 11. In such way, a read/write device may be used to program packaged data to the electronic patch 14 through the first programming terminals 441 exposed to the outside.

Optionally, the above-mentioned part of the functional terminals 33 after removing the film may include data terminals and clock terminals.

Optionally, when removing the film from the backside of the part of the functional terminals 33, the film may be removed by aligning the back centers of the terminals with a laser, and only the conductive regions with an area same as the area of the electrical connection terminals 43 may be exposed.

In the above-mentioned cases, it is possible to only remove the film from the backside of the part, not all, of the functional terminals 33 of the original chip 13, which may reduce the risk of electrical short between the terminals. After the electrical connection terminals 43 are electrically connected to the backs of the functional terminals 33, data connection may be established between the first memory 30 of the original chip 13 and the second memory 40 of the electronic patch 14. When the printer accesses the original chip 13, the access signal of the printer may be transmitted to the electronic patch 14 simultaneously. In some implementation manners, the area of the electrical connection terminal 43 may be less than the area of the connected functional terminal 33, such that the risk of short circuits between adjacent terminals may be reduced. Optionally, the area of the electrical connection terminal 43 may be less than any functional terminal 33.

Optionally, in other implementation manners of one embodiment, the electrical connection terminals 43 and the backs of the part of the functional terminals 33 may be electrically connected by pasting, leads, and the like. It should be understood that any manners that enable the second memory 40 to establish electrical communication with the printer through the plurality of functional terminals 33 falls within the protection scope of the present disclosure.

Those skilled in the art should understand that when only the related data of the first memory 30 in the original chip 13 needs to be repaired, the above-mentioned electrical connection terminals 43 may only need to be connected to the first terminal group and the third terminal group of the plurality of functional terminals 33. Moreover, the region where the above-mentioned electrical connection terminals 43 are disposed may be configured to correspond to the position of the functional terminals 33 to be connected, and also be configured to be outside the original chip 13 where the corresponding functional terminals may be electrically connected to the electrical connection terminals 43 through wires.

In one embodiment, the electronic patch 14 may further include a second positioning hole 42 disposed on the second substrate 41, and the center of the second positioning hole 42 may substantially coincide with the center of the first positioning hole 32. For example, the second positioning hole 42 may be exemplarily configured as a circular shape and arranged at a position corresponding to the first positioning hole 32 on the original chip 13, such that the center of the second positioning hole 42 may substantially coincide with the center of the first positioning hole 32.

In some implementation manners, the second positioning hole 42 may be configured as a concentric circle with a same size as the first positioning hole 32. When the electronic patch 14 is installed between the original chip 13 and the ink accommodation container 11, the center of the second positioning hole 42 may substantially coincide with the center of the first positioning hole 32. In other implementation manners, the second positioning hole 42 may be configured as a concentric circle with an area less than the area of the first positioning hole 32. After the electronic patch 14 is installed at an inner side of the original chip 13, the center of the second positioning hole 42 may substantially coincide with the center of the first positioning hole 32.

It should be understood that the second positioning hole 42 may be adjusted to match the first positioning hole 32 according to the position of the first positioning hole 32, such that the electrical connection terminals 43 of the electronic patch 14 may better align with the part of the corresponding functional terminals 33 of the original chip 13. The accurately aligned terminals may have stable signal transmission ability after electrical connection, which makes the connection operation easy. The positioning holes with substantially coincident centers may indicate whether the original chip 13 and the electronic patch 14 are aligned correctly. Through visual inspection or machine inspection, accurate alignment of the electronic patch 14 and the original chip 13 may be implemented. For example, when attaching the electronic patch 14, the positioning holes may be configured to be sleeved on a positioning post of a fixed component to verify whether the alignment of the electronic patch 14 and the original chip 13 is accurate.

Optionally, the ease of determining whether the alignment is accurate may be improved by reducing the area of the second positioning hole 42.

Optionally, in one embodiment, in order to achieve a more precise alignment, before the above-mentioned electrical connection terminals 43 and the part of the functional terminals 33 are electrically connected, the first positioning hole 32 and the second positioning hole 42 may be aligned, such that the center of the second positioning hole 42 may coincide with the center of the first positioning hole 32. For example, the first positioning hole 32 and the second positioning hole 42 may be aligned before soldering the electrical connection terminals 43 and the part of the functional terminals 33.

In some cases, the upgrade operation of the remanufactured ink cartridge 10 may not only involve data replacement, but also involve the change of the physical structure of the chip. For example, one or more test terminals configured to detect the installation of the ink cartridge may be added, or other memory structures and the like may be added to the remanufactured ink cartridge 10. In view of the above-mentioned case, the second substrate 41 may have a larger length dimension and/or width dimension, such that the second substrate 41 may have space for adding terminals or module structures. Therefore, the electronic patch 14 may have more possibilities of being reused.

Optionally, the first programming terminals 441 exposed to the outside may be more beneficial for repeat programming of the data in the electronic patch 14, and the programming step may not be limited to be performed after the electronic patch 14 is installed. For example, when the ink cartridge is remanufactured to form the remanufactured ink cartridge 10 for the first time, packaged data may first be programmed into the electronic patch 14, and the electronic patch 14 may then be electrically connected to the inner side of the original chip 13. Or, for example, the electronic patch 14 may first be electrically connected to the inner side of the original chip 13, and packaged data may then be programmed into the electronic patch 14. Moreover, when the remanufactured ink cartridge 10 is re-recycled and repair or upgrade operations are performed, there is no need to peel off the electronic patch 14, and the packaged data for repairing or upgrading may be directly programmed from the first programming terminals 441 to the electronic patch 14.

It should be understood that the electronic patch 14 may not only be attached to the inner side of the original chip 13, and in some implementation manners, the electronic patch 14 may also be attached to the outer side of the original chip 13. As long as the necessary programming terminals (e.g., programming terminals configured to program the data for repairing or data for upgrading to the electronic patch) are exposed outside the original chip 13, the remanufacturing manners, such as repair, upgrade or the like, of the remanufactured ink cartridge 10 may be implemented without peeling off the electronic patch 14.

A method for forming a remanufactured ink cartridge is also provided in one embodiment. The method may include:

disposing the electronic patch 14 including the second memory 40 between the ink accommodation container of the original ink cartridge and the original chip 13, such that the electrical connection terminals 43 of the electronic patch 14 may be connected to the part of the functional terminals 33 of the original chip 13, and at least one terminal of the electronic patch 14 configured to program data to the second memory 40 is exposed outside the original chip 13, thereby forming a remanufactured ink cartridge 10.

The at least one terminal configured to program data to the second memory 40 may include the first programming terminal 441 and/or the second programming terminal 442 described above, and the programmed data may be the data for repairing or data for upgrading.

The above formed remanufactured ink cartridge 10 may use its exposed terminals, configured to program data, to repeatedly program data to the second memory 40, such that the data may be repaired or upgraded repeatedly without peeling off the electronic patch 14.

It should be understood that in one embodiment, the step sequence of programming data may not be limited. For example, the electronic patch 14 may first be attached to the remanufactured cartridge 10, and the data may then be programmed into the electronic patch 14; or packaged data may be programmed into the electronic patch 14 before attaching the electronic patch 14 to the remanufactured ink cartridge 10.

The present disclosure provides the remanufactured ink cartridge, the electronic patch, and the method for forming the remanufactured ink cartridge. The first programming terminals configured to program the data to the second memory may be exposed to the outside. On one hand, the remanufacturing process of the remanufactured ink cartridge may be simple. It is possible that the electronic patch may be attached to the remanufactured ink cartridge, and then the data may be programed to the electronic patch; and it is also possible that the data may be programed to the electronic patch, and then the electronic patch may be attached to the remanufactured ink cartridge. On the other hand, the repair, subsequent repair and upgrade of the remanufactured ink cartridge may be easy, that is, the fully installed remanufactured ink cartridge may be repaired or upgraded according to actual production requirements. In particular, for the subsequent repair and upgrade of the remanufactured ink cartridge, there is no need to peel off the electronic patch from the remanufactured ink cartridge, and the data may be directly programmed to the electronic patch through the exposed first programming terminals. In such way, the electronic patch may be recycled and flexibly adapted to the subsequent repair or upgrade and reutilization of the ink cartridge, which may not only reduce the environmental protection problem, but also reduce the complexity of the remanufacturing process.

Furthermore, the solution of the present disclosure may also improve the alignment accuracy between the soldering terminals, reduce the short circuit risk of the attached chip circuit, and in particular, improve the environmental protection of the ink cartridge remanufacturing technology.

In the description of the present disclosure, it should also be noted that the terms "configure", "install", "connected", and "connection" are to be understood broadly unless otherwise specifically stated and defined; for example, it may be a fixed connection, a detachable connection, or an integrated connection; it may be a mechanical connection or an electrical connection; and it may be a direct connection or indirect connection through an intermediate medium and may be an internal connection between the two elements. The specific meanings of the above-mentioned terms in the present disclosure may be understood in the specific circumstances for those skilled in the art.

The above-mentioned disclosed embodiments are exemplary only and are not intended to limit the scope of the present disclosure. Although the present disclosure has been described in detail with reference to the above-mentioned embodiments, those skilled in the art should understand that the technical solutions described in the above-mentioned embodiments may still be modified, or some or all of the technical features may be equivalently replaced. However, such modifications or replacements do not make the essence of the corresponding technical solutions to deviate from the scope of the technical solutions of the embodiments of the present disclosure.

INDUSTRIAL APPLICABILITY

The present disclosure provides the remanufactured ink cartridge, the electronic patch, and the method for forming the remanufactured ink cartridge, such that the remanufacturing technology of the remanufactured ink cartridge may be simple, and the data may be repeatedly program to the electronic patch without peeling off the electronic patch.

What is claimed is:

1. A remanufactured ink cartridge, comprising:

an ink accommodation container;

a cartridge chip circuit, the cartridge chip circuit including a first substrate disposed at an outer side of the ink accommodation container, wherein the cartridge chip circuit further includes a first memory; and an electronic patch, the electronic patch including a second substrate, the second substrate including a first surface and an opposing second surface, the first surface facing toward the first substrate of the cartridge chip circuit and the second surface facing toward the the ink accommodation container, wherein: the electronic patch further includes a second memory and first programming terminals electronically connected to the second memory; the first programming terminals are configured to program data for repairing to the second memory; the data for repairing is configured to repair or replace at least a portion of data in the first memory; and at least one of the first programming terminals is exposed outside the cartridge chip circuit.

2. The remanufactured ink cartridge according to claim 1, wherein: a partial region of the second substrate is exposed outside the first substrate; and the at least one of the first programming terminals is disposed at the partial region of the second substrate.

3. The remanufactured ink cartridge according to claim 2, wherein: a length of the second substrate is greater than a length of the first substrate, and/or a width of the second substrate is greater than a width of the first substrate, to form the partial region.

4. The remanufactured ink cartridge according to claim 1, wherein: the cartridge chip circuit includes a first positioning hole, and the electronic patch includes a second positioning hole, wherein a center of the second positioning hole substantially coincides with a center of the first positioning hole.

5. The remanufactured ink cartridge according to claim 4, wherein: an area of the second positioning hole is less than or equal to an area of the first positioning hole.

6. The remanufactured ink cartridge according to claim 1, wherein: the cartridge chip circuit further includes functional terminals; and the electronic patch further includes electrical connection terminals, electrically connected to the functional terminals.

7. The remanufactured ink cartridge according to claim 6, wherein: the electronic patch further includes second programming terminals, electronically connected to the second memory through the electrical connection terminals; and at least one of the second programming terminals is exposed outside the cartridge chip circuit.

8. The remanufactured ink cartridge according to claim 6, wherein: the electrical connection terminals are soldered to the at least one of the functional terminals.

9. The remanufactured ink cartridge according to claim 6, wherein: an area of an electrical connection terminal of the electrical connection terminals is less than an area of a functional terminal of the functional terminals.

10. The remanufactured ink cartridge according to claim 6, wherein: a quantity of the electrical connection terminals included in the electronic patch is less than a quantity of the functional terminals included in the cartridge chip circuit.

11. The remanufactured ink cartridge according to claim 6, wherein: the functional terminals include data terminals and clock terminals.

12. A remanufactured ink cartridge, comprising:

an accommodation container;

a printhead;

a cartridge chip circuit, including a first substrate, wherein a plurality of functional terminals is arranged on the first substrate; and an electronic patch, including a second substrate, the second substrate including a first surface and an opposing second surface, the first surface facing toward the first substrate of the cartridge chip circuit and the second surface facing toward the accommodation container, wherein a plurality of soldering terminals and a plurality of programming terminals are arranged on the second substrate; and the plurality of soldering terminals is electrically connected to a part of the plurality of functional terminals, wherein: a length and/or a width of the second substrate are greater than a length and/or a width of the first substrate; and at least one of the plurality of programming terminals is configured to be arranged at a position of the second substrate that has the greater length and/or the greater width; or the first substrate and the second substrate are staggered with each other, thereby forming an exposed partial region; and the at least one of the plurality of programming terminals is configured to be arranged at the exposed partial region.

13. The remanufactured ink cartridge according to claim 12, wherein: a first positioning hole is disposed at the first substrate, and a second positioning hole is disposed at the second substrate.

14. The remanufactured ink cartridge according to claim 13, wherein: a center of the second positioning hole substantially coincides with a center of the first positioning hole; and/or an area of the second positioning hole is less than an area of the first positioning hole.

15. The remanufactured ink cartridge according to claim 12, wherein the plurality of soldering terminals of the electronic patch is soldered on a backside of the part of the plurality of functional terminals.

16. The remanufactured ink cartridge according to claim 12, wherein: the plurality of programming terminals includes first programming terminals and second programming terminals; and the second programming terminals are electrically connected to the plurality of soldering terminals.

17. The remanufactured ink cartridge according to claim 12, wherein: a quantity of the plurality of soldering terminals is less than a quantity of the plurality of functional terminals.

18. An electronic patch, comprising:

a second substrate including a first surface and an opposing second surface, the first surface facing toward a first substrate of a cartridge chip circuit and the second surface facing toward an ink accommodation container of a remanufactured ink cartridge;

a second memory;

electrical connection terminals, configured to establish an electrical communication with a probe of a printer through at least one terminal of the cartridge chip circuit; and first programming terminals, connected to the second memory, wherein the first programming terminals are configured to program data for repairing or data for upgrading of at least a portion of data in the cartridge chip circuit to the second memory, wherein at least one of the first programming terminals is exposed outside the cartridge chip circuit.

19. The electronic patch according to claim 18, further including:

second programming terminals, connected to the second memory through the electrical connection terminals, wherein at least one of the second programming terminals is exposed outside the cartridge chip circuit.

20. The electronic patch according to claim 18, wherein: a quantity of the electrical connection terminals included in the electronic patch is less than a quantity of terminals in the cartridge chip circuit.

* * * * *